US006408958B1

(12) United States Patent
Isbell et al.

(10) Patent No.: US 6,408,958 B1
(45) Date of Patent: Jun. 25, 2002

(54) SUPERABRASIVE CUTTING ASSEMBLIES INCLUDING CUTTERS OF VARYING ORIENTATIONS AND DRILL BITS SO EQUIPPED

(75) Inventors: Matthew R. Isbell; Rudolf C. O. Pessier, both of Houston; Michael L. Doster, Spring; Mark W. Dykstra, Kingwood; William H. Heuser, The Woodlands, all of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/694,518

(22) Filed: Oct. 23, 2000

(51) Int. Cl.[7] ..... E21B 10/16
(52) U.S. Cl. ..... 175/431; 175/432
(58) Field of Search ..... 175/425, 428, 175/431, 432, 399, 393, 429

(56) References Cited

U.S. PATENT DOCUMENTS

| | | | | | |
|---|---|---|---|---|---|
| 4,554,986 | A | | 11/1985 | Jones | |
| 4,718,505 | A | | 1/1988 | Fuller | |
| 4,823,892 | A | | 4/1989 | Fuller | |
| 4,889,017 | A | | 12/1989 | Fuller et al. | |
| 4,942,933 | A | | 7/1990 | Barr et al. | |
| 4,981,184 | A | * | 1/1991 | Knowlton et al. | 175/329 |
| 4,991,670 | A | | 2/1991 | Fuller et al. | |
| 5,186,268 | A | | 2/1993 | Clegg | |
| 5,222,566 | A | | 6/1993 | Taylor et al. | |
| 5,244,039 | A | | 9/1993 | Newton, Jr. et al. | |
| 5,287,936 | A | | 2/1994 | Grimes et al. | |
| 5,303,785 | A | | 4/1994 | Duke | |
| 5,346,026 | A | | 9/1994 | Pessier et al. | |
| 5,435,403 | A | | 7/1995 | Tibbitts | |
| 5,467,836 | A | | 11/1995 | Grimes et al. | |
| 5,487,436 | A | * | 1/1996 | Griffin | 175/432 |
| 5,531,281 | A | | 7/1996 | Murdock | |
| 5,595,252 | A | | 1/1997 | O'Hanlon | |
| 5,655,612 | A | | 8/1997 | Grimes et al. | |
| 5,706,906 | A | | 1/1998 | Jurewicz et al. | |
| 5,720,357 | A | * | 2/1998 | Fuller et al. | 175/428 |
| 5,957,227 | A | | 9/1999 | Besson et al. | |
| 6,003,623 | A | | 12/1999 | Miess | |
| 6,050,354 | A | | 4/2000 | Pessier et al. | |
| 6,089,336 | A | * | 7/2000 | Nexton et al. | 175/393 |
| 6,123,161 | A | | 9/2000 | Taylor | |
| 6,151,960 | A | * | 11/2000 | Taylor et al. | 175/427 X |
| 6,298,930 | B1 | * | 10/2001 | Sinor et al. | 175/428 |

* cited by examiner

*Primary Examiner*—Frank S. Tsay
(74) *Attorney, Agent, or Firm*—TraskBritt

(57) ABSTRACT

A cutting assembly comprised of first and second superabrasive cutting elements including at least one rotationally leading cutting element having a cutting face oriented generally in a direction of intended rotation of a bit on which the assembly is mounted to cut a subterranean formation with a cutting edge at an outer periphery of the cutting face, and a rotationally trailing cutting element oriented substantially transverse to the direction of intended bit rotation and including a relatively thick superabrasive table configured to cut the formation with a cutting edge located between a beveled surface at the side of the superabrasive table and an end face thereof. A rotationally trailing cutting element may be associated with and disposed at a location on the bit at least partially laterally intermediate locations of two rotationally leading cutting elements. Drill bits equipped with the cutting assembly are also disclosed.

40 Claims, 9 Drawing Sheets

SUPERABRASIVE CUTTING ASSEMBLIES INCLUDING CUTTERS OF VARYING ORIENTATIONS AND DRILL BITS SO EQUIPPED

BACKGROUND OF THE INVENTION

1. Field of the Invention

The invention relates generally to rotary drag bits for drilling subterranean formations and, more particularly, to rotary drag bits employing superabrasive backup cutters rotationally trailing superabrasive primary cutters on selected areas over the bit face.

2. State of the Art

So-called "backup" cutters have been conventionally employed for some time on rotary drag bits employing superabrasive primary cutters in the form of polycrystalline diamond compacts, or PDC's, the primary cutters being oriented with their superabrasive cutting faces oriented generally in the direction of intended bit rotation. Backup cutters are typically employed for drilling applications involving penetration of hard or abrasive subterranean formations. The use of backup cutters has proven to be a convenient technique for gaining more superabrasive volume bearing on the formation to extend the life of a bit and enhance its stability without the necessity of designing the bit with excess blades to carry more PDC's, the presence of additional blades increasing the design complexity and fabrication cost of the bit as well as potentially compromising bit hydraulics due to reduced flow area over the bit face and less-than-optimum nozzle placement. However, conventional backup cutters are fairly aggressive, and their placement and orientation on a blade, in combination with associated primary cutters, may lead to balling of the blade area with formation material.

Various approaches have been taken to increasing the wear-resistance of rotary drag bits using hard or superabrasive structures on the bit face in addition to superabrasive cutters. For example, U.S. Pat. No. 4,554,986 to Jones discloses the use of "relatively hard" wear elements such as tungsten carbide or diamond on ridges rotationally leading an associated row of superabrasive cutters. U.S. Pat. Nos. 4,718,505 and 4,823,892 to Fuller disclose the use of so-called "abrasion elements" trailing a primary cutting structure, the abrasion elements comprising superabrasive particles embedded in a stud trailing a preform synthetic diamond cutter or embedded in a stud carrying a preform synthetic diamond cutter. U.S. Pat. Nos. 4,889,017 and 4,991,670 to Fuller et al. disclose the use of so-called "second" cutting structures carrying embedded superabrasive particles and rotationally trailing "first" cutters comprising preform synthetic diamond. U.S. Pat. No. 4,942,933 to Barr et al. discloses "back-up" assemblies comprising, for example, bosses of cemented tungsten carbide impregnated with natural diamonds and rotationally trailing other cutter assemblies. U.S. Pat. No. 5,186,268 to Clegg discloses the use of so-called "secondary elements" rotationally trailing "primary" cutting elements and alternatively comprising superabrasive particles embedded in a stud, a single superabrasive body embedded in the outer tip of a stud, or a domed-end stud or "button" over which is applied an outer layer of polycrystalline diamond. U.S. Pat. No. 5,222,566 to Taylor et al. depicts, but does not appear to discuss, structures rotationally trailing cutter assemblies carried on leading edges of blades on a bit. U.S. Pat. No. 5,244,039 to Newton et al. discloses the use of "secondary elements" rotationally trailing primary cutting elements, the exposure of the secondary elements varying with distance from the nose portion of the bit face. U.S. Pat. No. 5,303,785 to Duke discloses the use of ribs carrying PDC cutting elements at rotationally leading ends thereof, the ribs carrying diamond or other ultra-hard segments embedded in the outwardly facing surfaces thereof and rotationally behind the PDC cutting elements. U.S. Pat. No. 5,595,252 to O'Hanlon discloses the alternative use of structures either rotationally trailing or leading preform cutting elements to control penetration of the latter into a formation being drilled.

Drill bits carrying conventional structures to reduce wear resistance fail to provide sufficient enhancement of the volume of superabrasive material in critical areas over the bit face, and are not effective in providing a dynamically stable cutting action due to their radial aggressiveness.

BRIEF SUMMARY OF THE INVENTION

The present invention provides a radially unaggressive, tangentially efficient supplemental cutting element exhibiting a relatively large volume of superabrasive material for enhanced impact and wear resistance of an associated, more aggressive, differently oriented cutting element on the body of a rotary drag bit, as well as affording protection for the bit body and enhanced stability during drilling. The supplemental cutting element is configured and mounted on the bit body so as to minimize additional torque required to rotate the bit by providing a bearing surface under forces pushing the supplemental cutting element against the formation being drilled in a direction substantially perpendicular to the bit face profile at the location of the supplemental cutting element while affording the capability of cutting the formation being drilled with the superabrasive material of the supplemental cutting element in the direction of bit rotation should one or more associated primary cutting elements unduly wear or fail during drilling.

The present invention comprises a cutting assembly for use in rotary drag bits, such cutting assembly comprising, in one embodiment, a first, relatively more aggressive cutting element having a superabrasive table with a cutting face oriented generally in a direction of intended bit rotation, and a second, relatively less aggressive cutting element rotationally trailing the first cutting element, at substantially the same radial position over the bit face and having a superabrasive table oriented generally perpendicular to the profile of the bit face. The superabrasive table of the second cutting element may be carried on the outer end of a substrate configured as a stud-like carrier element over which the superabrasive table is formed and extends over the entire cross-section of the carrier element. It is preferable that the superabrasive table of the second cutting element exhibit a substantial thickness, a beveled, semifrustoconical rake face (at least facing in the direction of intended bit rotation) of considerable dimension, and a clearance face at a radially inner periphery of the rake face. The rake face may comprise a continuous, arcuate surface, or a series of laterally adjacent facets together simulating an arcuate surface.

In another embodiment of the invention, the second cutting element may be located at a position along the profile of the bit intermediate, or at least partially lying between, two first, relatively more aggressive, rotationally leading cutting elements.

The second cutting element is preferably slightly tilted with respect to a perpendicular to the profile of the bit face at the location of the second cutting element in a direction away from the intended direction of bit rotation so as to form a small clearance angle between the clearance face and the face of a formation being cut when the bit is drilling. Further, the second cutting element may be underexposed relative to its associated first cutting element; that is to say, the second cutting element protrudes from the bit profile a lesser distance than the first cutting element. In addition, the second cutting element may be side raked with respect to an associated first cutting element or elements.

Rotary drag bits including a plurality of cutting assemblies as described above are also within the scope of the present invention. Such bits may particularly feature such cutting assemblies on the shoulder region of the bit profile, although the invention is not so limited. It is contemplated that cutting assemblies of both of the foregoing configurations may be employed on the same drill bit. Stated another way, cutting assemblies comprising a single first cutting element and a single second cutting element may be employed on a bit in combination with cutting assemblies wherein two first, radially offset cutting elements have a second, at least partially radially intermediate cutting element associated therewith.

In various embodiments, the second cutting elements of the cutting assemblies of the invention provide significant protection against wear of the material of the bit body, and particularly on vertically, or axially, oriented portions of the bit body profile. If a first cutting element breaks, a trailing, second cutting element takes over to cut the formation. While performance may be diminished in such situations, the presence of the second cutting element prevents ring-out or groove-out of the bit body or blade on the profile, thus permitting replacement of the failed first cutting element when the bit is tripped from the well bore and rerunning of the bit. In addition, the placement and orientation of the second cutting elements promote enhanced bit stability even in situations where breakage of the first cutting element does not occur.

Other features and advantages of the present invention will become apparent to those of skill in the art through a consideration of the ensuing description, the accompanying drawings, and the appended claims.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
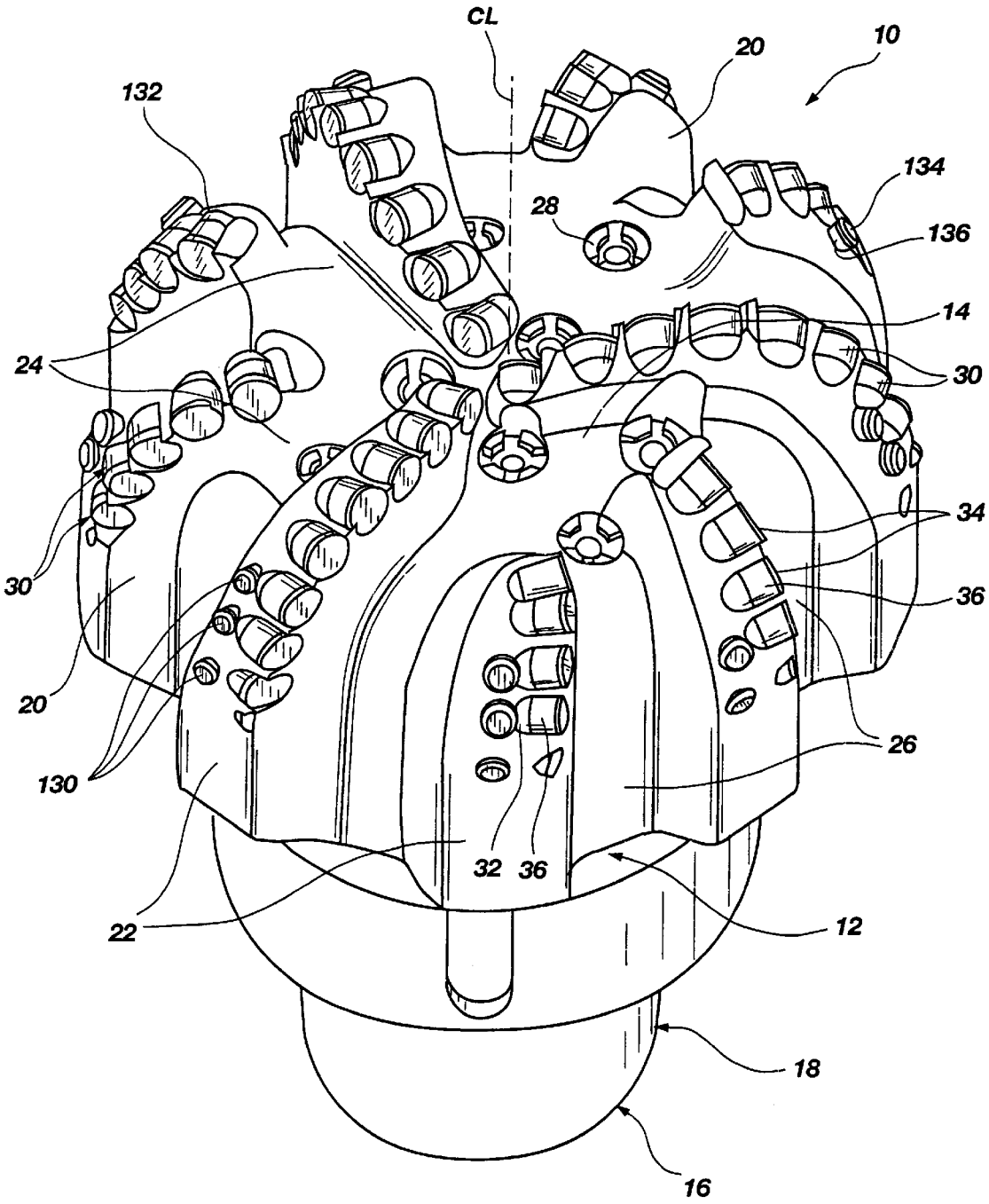
FIG. 1 comprises a perspective elevation of a first embodiment of a rotary drag bit according to the invention, inverted from a normal drilling orientation for clarity.
Figure 2:
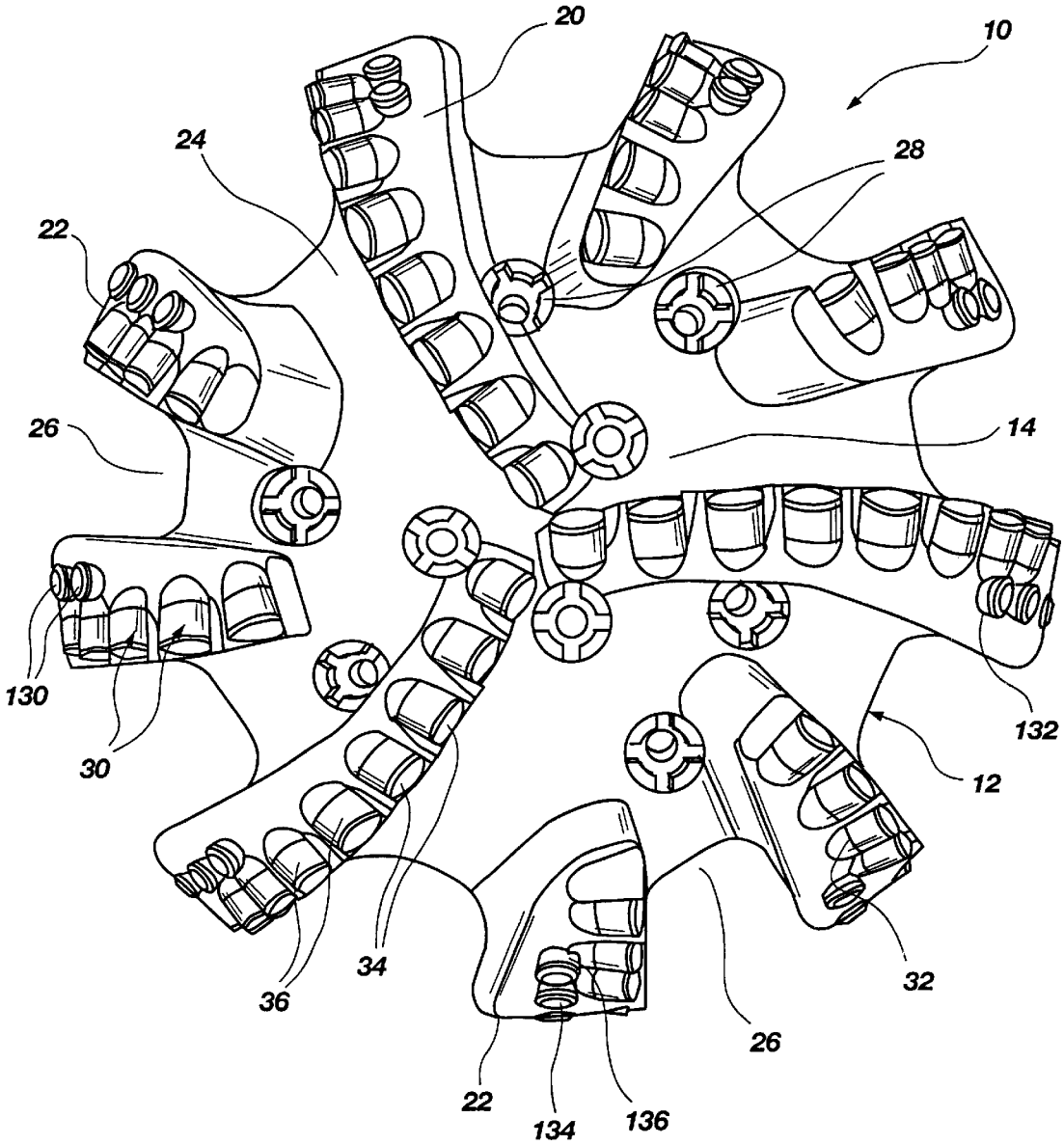
FIG. 2 comprises a face elevation of the rotary drag bit of claim 1, looking upward at the bit face from below as the bit is normally oriented for drilling.

In all of the drawing figures, similar features and elements will be identified with the same reference numerals for clarity.

Referring now to FIGS. 1 through 7 of the drawings, a first embodiment 10 of a drill bit according to the present invention comprises a bit body 12 having a bit face 14 at one end thereof and being secured at an opposing end to shank 16 with bearing threads 18 thereon for connecting the bit 10 to a drill string for rotation thereof and application of weight thereto, as known in the art. Bit 10 includes a plurality of generally radially extending blades 20 above (as the bit is oriented in FIG. 1) the bit face 14 and extending to integral, laterally extending gage pads 22 at the side of the bit body 12. The profile of the bit 10 or, more specifically, of the body 12, lies along outer edges of the blades 20 between the centerline CL of the bit 10 to gage pads 22. A plurality of generally radially extending fluid passages 24 extends between blades 20 from locations proximate the centerline CL of the bit 10 to junk slots 26 located between gage pads 22.

A plurality of nozzles 28 is disposed in apertures in the bit face 14, as known in the art, nozzles 28 being at the distal ends of passages leading from an interior plenum or other passage communicating with the hollow interior of shank 16, which in use receives drilling fluid from a drill string to which bit 10 is secured, as well known in the art.

Figure 7:
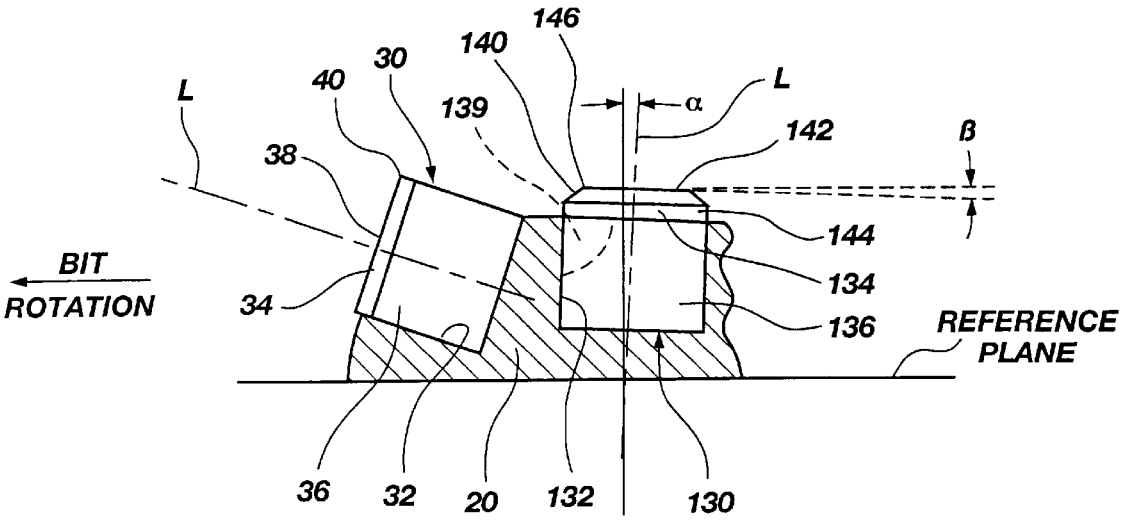
FIG. 7 is a side elevation of one embodiment of a cutting assembly comprising first and second cutting elements in accordance with the invention.

Each blade 20 carries a plurality of first cutting elements 30 disposed in pockets 32 opening onto the outer edge as well as the rotationally leading edge of the blade, and so are exposed above the blade. First cutting elements 30 preferably comprise PDC cutting elements comprised of substantially disc-shaped polycrystalline diamond compact superabrasive tables 34 formed on substantially cylindrical supporting substrates 36, typically (but by way of example only) of cemented tungsten carbide. First cutting element 30 has a longitudinal axis L (see FIG. 3), which, in the disclosed embodiment, also comprises a centerline for cutting element 30. First cutting elements 30 are conventionally negatively back raked, having their cutting faces 38 tilted to the rear, away from the direction of intended bit rotation, to reduce aggressivity of the cutting edges 40 engaging the formation as the bit rotates and weight on bit (WOB) is applied. Exemplary back rakes for first cutting element 30 place longitudinal axis L at an angle in the range of from about 10° to about 45° to a reference plane tangent to the bit face proximate the location of the rotationally trailing end of first cutting element 30 and an associated second cutting element 130, as illustrated in FIG. 7 and as further described below. Bit body 12 as depicted in FIGS. 1 through 4 comprises a so-called "matrix" bit body of particulate metal (typically tungsten carbide, steel or a mixture of both) infiltrated with a hardened liquid binder (typically copper based). First cutting elements 30 are brazed in pockets 32 by their substrates 36. However, the present invention is not limited to matrix-type bits, but may also be employed with steel body bits wherein cutting elements are also brazed into place as with matrix-type bits, or can be secured to studs, the ends of which are inserted in apertures formed in the blades or elsewhere in the steel bit body.

Also secured to blades 20 and in the shoulder region of the bit face 14 (see especially FIGS. 3 and 4) is a plurality of second cutting elements 130, also each preferably comprised of a disc-like superabrasive table 134 formed on a substantially cylindrical, supporting cemented carbide substrate 136. Second cutting elements 130 are each mounted in pockets 132 rotationally behind and in substantial radial alignment over the bit face 14 (in this embodiment, on the same blade 20) with a rotationally leading first cutting element 30, each such pairing of a first cutting element 30 with a second cutting element 130 comprising a cutting assembly according to the invention. Unlike first cutting elements 30, however, second cutting elements 130 are oriented substantially transverse to the bit face (or, for simplicity, to the aforementioned reference plane), with the sides of superabrasive tables 134 facing in an intended direction of bit rotation.

Second cutting elements 130 may preferably comprise cutting elements as described in U.S. Pat. No. 5,706,906 to Jurewicz et al., assigned to the assignee of the present invention, the disclosure of which is hereby incorporated herein by this reference. With specific reference to FIGS. 6 and 7 of the drawings herein, such cutting elements 130 preferably have a superabrasive table 134 comprising a disc-like polycrystalline diamond compact formed on and extending across the end of a substantially cylindrical substrate 136, second cutting element 130 having a longitudinal axis L.

Second cutting elements 130 are preferably oriented on the bit face at a slight angle to the perpendicular to the bit face (or reference plane) at the cutting element location, preferably tilted to the rear and away from the intended direction of rotation at a slight angle $\alpha$ (see FIG. 6), which angle also results in a so-called "clearance angle" $\beta$ between second cutting element 130 and the formation being cut as explained in more detail below.

Superabrasive table 134 preferably has a rake face 140, at least on the part of the superabrasive table facing in the direction of intended bit rotation. Rake face 140 may comprise a bevel at the lateral periphery of the superabrasive table 134 extending completely thereabout and defining a frustoconical surface, or merely lie along a portion of the periphery, defining an arcuate, semifrustoconical surface as depicted on the left-hand side of FIG. 6. Alternatively, rake face 140 may comprise a series of laterally adjacent facets together simulating a frustoconical or semifrustoconical surface as depicted on the right-hand side of FIG. 6.

The outer, or end, face of superabrasive table 134 comprises a clearance face 142 oriented perpendicularly to the longitudinal axis of second cutting element 130, and rake face 140 extends from clearance face 142 to side wall 144 of superabrasive table 134. A cutting edge 146 is defined along the arcuate boundary (or, in the case of a faceted rake face, substantially arcuate boundary) between rake face 140 and clearance face 142. The thickness of the superabrasive table 134, measured parallel to longitudinal axis L and from the clearance face 142 to the boundary 148 between superabrasive table 134 and substrate 136 at the side wall 144 of superabrasive table 134, is preferably at least about 0.030 inch and, more preferably, about 0.100 to 0.110 inch. The depth of the rake face 140, measured parallel to the longitudinal axis of the cutter and between the clearance face 142 and the side wall 144, is quite substantial, preferably on the order of at least about 0.030 inch and, more preferably, about 0.050 inch. Rake face 140 is also oriented at an angle to a longitudinal axis of cutting element 130, for example at a 45° angle thereto, although other angles between about 10°and 80°, and more preferably between 30° and 60°, may also be suitable. Of course, the tilt angle of second cutting element 130 or of clearance face 142 may be varied in combination with the orientation of rake face 140 to provide the desired degree of aggressiveness to cut the formation tangentially without being unduly radially aggressive.

Second cutting elements 130 may be underexposed (i.e., be vertically farther from the formation) relative to cutting edges 40 of first cutting elements 30 by a given dimension, for example 0.100 inch. The degree of underexposure may vary, as desired, to preclude tangential, substantially aggressive engagement of a second cutting element 130 with a formation being drilled until such time as its associated first cutting element wears to a given degree. Alternatively, exposure of second cutting element 130 may be selected to act as a penetration limiter for associated first cutting element 130, or may be selected so that second cutting element 130 immediately engages a formation, providing additional superabrasive material volume bearing on the formation from the inception of drilling. As may be readily observed by reference to FIGS. 3, 4 and 7 of the drawings, second cutting elements 130 may be mounted to protrude significantly above the surfaces of blades 20 while still being underexposed with respect to cutting edges 40 of first cutting elements 30 so as to facilitate fluid movement and formation debris clearance about second cutting elements 130. As perhaps best shown in FIG. 5, the exposure of second cutting elements 130 with respect to the cutting edges 40 of first cutting elements 30 may vary with each respective cutting assembly.

It is significant that the exposure of second cutting element 130 should be such that the depth of cut taken of the formation should not exceed the thickness of the superabrasive table 134 at the side wall 144. Otherwise, damage to the second cutting element 130 may result from delamination of superabrasive table 134 from substrate 136, or abrasive or impact damage to substrate 136 may result. Further, and as noted above, second cutting elements 130 are preferably tilted away from the direction of intended bit rotation so as to elevate cutting edge 146 above clearance face 142 in the direction of intended bit rotation and facilitate shearing of the formation material. In the disclosed embodiment, this tilt comprises a tilt of longitudinal axis L of second cutting element 130. The angle of tilt $\alpha$ of the second cutting element 130 also tilts the clearance face, which is perpendicular to longitudinal axis L, resulting in the aforementioned clearance angle $\beta$ between the clearance face and the formation. Tilt angle $\alpha$, and thus clearance angle $\beta$, may range from about 3° to about 25° degrees. Optionally, a clearance angle $\beta$ may be achieved by forming the clearance face 142 to exhibit a slant or tilt away from a plane perpendicular to longitudinal axis L and rotationally orienting second cutting element 130 appropriately so that it may be mounted without tilt. A tilt angle $\alpha$ of less than 3°, and thus a similar clearance angle $\beta$, performs substantially as if no clearance angle is provided.

Second cutting elements 130 may also be configured, by way of example, as certain superabrasive gage cutters disclosed in U.S. Pat. Nos. 5,287,936, 5,346,026, 5,467,836 and 6,050,354 and U.S. patent application Ser. No. 09/212,057, all assigned to the assignee of the present invention and the disclosure of each of which is hereby incorporated herein by this reference. One particularly suitable configuration for second cutting element 130 is disclosed in the aforementioned U.S. Pat. No. 6,050,354, FIG. 13, wherein the superabrasive table 134 exhibits multiple chamfers at its periphery. Yet another suitable configuration for second cutting element 130 is disclosed in U.S. patent application Ser. No. 09/205,138, assigned to the assignee of the present invention, the disclosure of which is hereby incorporated herein by this reference. In the '138 application, a sheath or jacket of superabrasive material extends from the table over and along one side of the substrate. A complex, grooved interface-geometry between the superabrasive material and the substrate is employed on both the substrate end and the substrate side covered by the superabrasive material. As shown in FIG. 7 of the drawings in broken lines, the sheath or jacket 139 would be placed to face generally in the direction of intended bit rotation for protection of the substrate 136.

Other suitable configurations for second cutting element 130 are disclosed in U.S. Pat. No. 6,003,623 to Miess.

In operation, a cutting assembly (see FIG. 7) comprising a first cutting element 30 and a second cutting element 130 according to the invention cuts a formation being drilled with the cutting edge 40 of the first, rotationally leading cutting element 30 as the bit rotates and WOB is applied, the second cutting element 130 then engaging the formation if the depth of cut of the first cutting element 30 is sufficient (presuming the two cutting edges 40 and 146 are not at the same exposure, such arrangement also contemplated as being within the scope of the invention). Due to the substantially transverse orientation of the second cutting element 130 to the bit profile at the location of the second cutting element 130, the clearance face 142 and adjacent rake face 140 in the direction of bit rotation together provide a very radially unaggressive structure to the formation, while the cutting edge 146 located between the clearance face 142 and rake face 140 cuts the formation tangentially (to the arc traversed by the cutting edge as the bit rotates) in a very efficient manner. The clearance angle β provided by the preferable slight tilt of the second cutting element 130 (or, alternatively, a slanted clearance face 142) precludes the formation from merely riding on the clearance face 142 of the second cutting element 130, promotes drilling fluid flow behind the cutting edge 146 of the second cutting element 130, and thus facilitates cooling of the superabrasive table 134 and removal of formation fines. The presence of the robust superabrasive tables 134 of the second cutting elements 130 provides, in contrast to conventional bits and even those employing so-called "backup cutters", substantially enhanced superabrasive volume to reduce wear on the superabrasive table 34 and on adjacent portions of the bit body 12, such as blades 20. Thus, life of the superabrasive table 34 is prolonged, and reduced wear of the bit body 12 prolongs its life and enhances repairability of the bit 10.

The location of cutting assemblies of the invention in the shoulder area of a bit, as disclosed herein, presents additional superabrasive volume to the formation in locations over the bit face where cutting element travel and speed are close to a maximum (due to location at radii close to the gage diameter of the bit) and cutting elements are subjected to from significant to extreme tangential (also known as torsional) loading adjacent an area of the formation exhibiting relatively high strength, as discussed in greater detail in U.S. Pat. No. 5,435,403 to Tibbitts et al., assigned to the assignee of the present invention and the disclosure of which is hereby incorporated herein by this reference. Thus, bits equipped in the shoulder area of at least some of the blades with cutting assemblies according to the present invention exhibit enhanced durability in combination with effective cutting action enhanced as required by the second cutting elements 130 due to excessive wear of, damage to or failure of first cutting elements 30 during drilling and without requiring compromises in bit design which may increase bit cost and degrade hydraulic performance. The second cutting elements 130 also provide a robust, superabrasive bearing surface under so-called bit "whirl" or other lateral bit precession or vibration, the bearing surface inhibiting the tendency of relatively more aggressive first cutting elements 30 to "bite" into the well bore wall.

The cutting assemblies of the present invention, both as previously as well as subsequently described herein, may be employed in conventional, substantially laterally balanced drill bits as well as so-called "anti-whirl" bits wherein a directed, lateral, imbalance force is intentionally established to push a side of the bit against the well bore wall to ride thereon substantially continuously on a bearing surface on the bit body, such as an enlarged, smooth gage pad or pads. The lateral imbalance force and smooth bearing surface are, in combination, intended to preclude destructive backward rotation, or "whirl", offset from the well bore axis, of the bit within the well bore. In an anti-whirl bit, the bit face circumferentially adjacent and below (as the bit is oriented for drilling) the bearing surface on the gage is often referred to as the "cutter devoid region" of the bit face, as the number of cutting elements is substantially reduced, or their presence even eliminated. Such a bit design may consequently incur undue damage to the bit face in the cutter devoid region. Cutting assemblies of the present invention may be placed in the cutter devoid region and specifically on the shoulder of the bit profile adjacent the gage, with first cutting elements 30 being substantially underexposed in comparison with first cutting elements 30 over the remainder of the bit face 14. Second cutting elements 130 associated with first cutting elements 30 in the cutter devoid region are underexposed with respect to their associated first cutting elements 30, as described herein. When such a bit is running smoothly, and has not initiated a tendency toward whirl, neither the first cutting elements 30 nor their associated second cutting elements 130 in the cutter devoid region contact the formation. When, however, bit stability begins to be compromised and an off-centering whirl tendency is exhibited, the cutting assemblies in the cutter devoid region engage the formation, cutting the formation and protecting the bit body while providing enhanced stability through contact of the superabrasive material of second cutting elements 130 with the formation.

Figure 8:
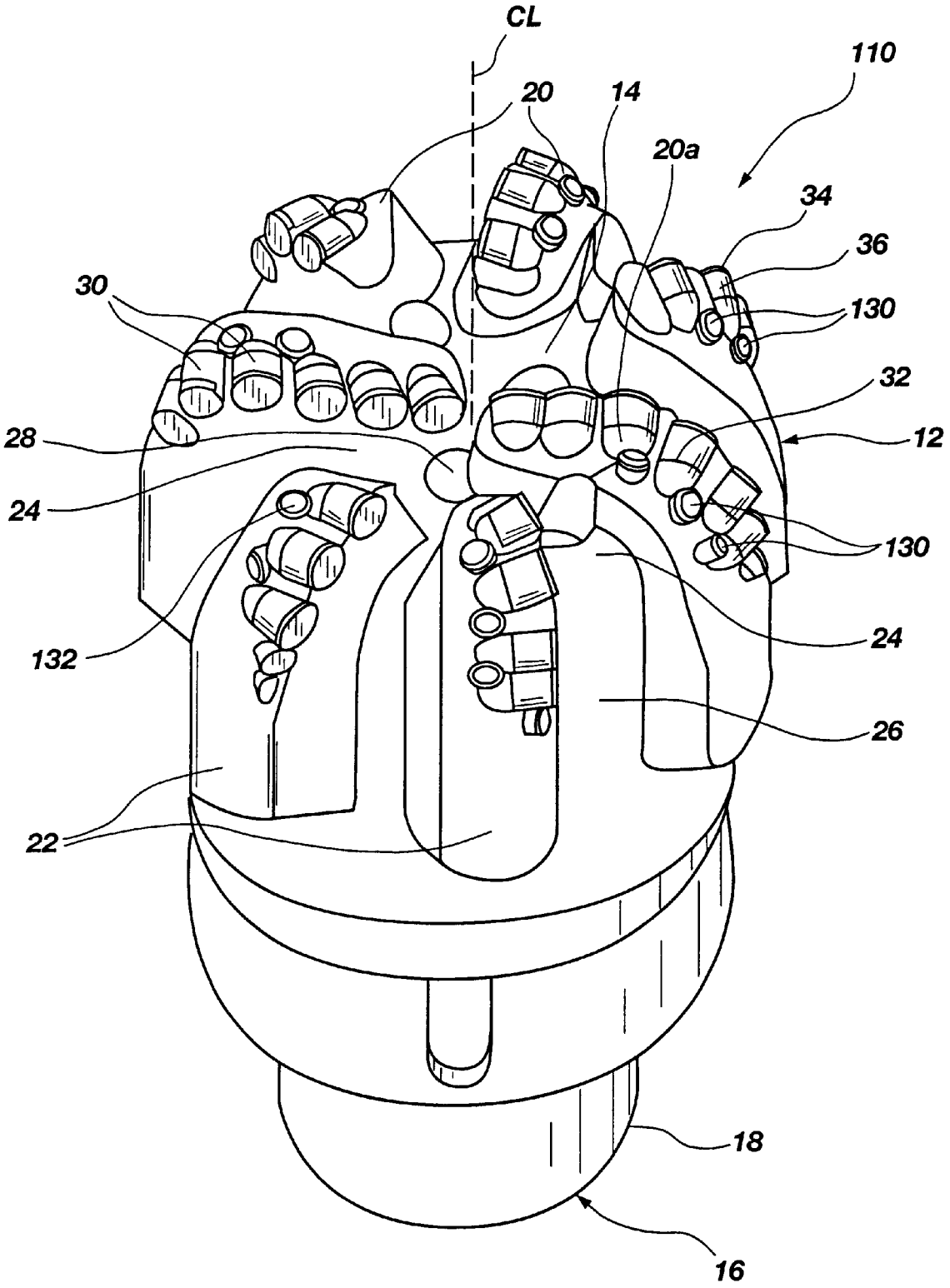
FIG. 8 comprises a perspective elevation of a second embodiment of a rotary drag bit according to the invention, inverted from a normal drilling orientation for clarity.

Referring now to FIG. 8 of the drawings, a second embodiment 110 of a drill bit according to the invention will be described. For clarity, elements and features of drill bit 10 which have previously been described are identified by the same reference numerals with respect to drill bit 110.

FIG. 8 shows, in perspective, drill bit 110 is similar to bit 10 and includes a bit body 12 having a bit face 14 at one end thereof and being secured at an opposing end to shank 16 with bearing threads 18 thereon. Bit 110 includes a plurality of generally radially extending blades 20 above (as the bit is oriented in FIG. 8) the bit face 14 and extending to integral, laterally extending gage pads 22 at the side of the bit body 12. The blades 20 define a plurality of generally radially extending fluid passages 24 therebetween extending from proximate a centerline CL of the bit 110 to junk slots 26 defined between gage pads 22.

A plurality of nozzles 28 is disposed in apertures in the bit face 14, as known in the art, nozzles 28 being at the distal ends of passages leading from an interior plenum or other passage communicating with the hollow interior of shank 16, which in use receives drilling fluid from a drill string to which bit 110 is secured, as is well known in the art.

Each blade 20 carries a plurality of first cutting elements 30 disposed in pockets 32 opening onto the rotationally leading edge of the blade. First cutting elements 30 preferably comprise PDC cutting elements comprised of substantially disc-shaped polycrystalline diamond compact superabrasive tables 34 formed on substantially cylindrical supporting substrates 36, typically (but by way of example only) of cemented tungsten carbide (see FIG. 3). First cutting elements 30, and their structure, configuration and orientation on drill bit 110 may be as previously described with respect to drill bit 10. Bit body 12 as depicted in FIG. 8 comprises a so-called "matrix" bit body of particulate metal (typically tungsten carbide, steel or a mixture of both) infiltrated with a hardened liquid binder (typically copper based), so that first cutting elements 30 are brazed in pockets 32 by their substrates 36. However, and as previously noted herein, the present invention is not limited to matrix-type bits, but may also be employed with steel body bits wherein cutting elements are also brazed into place or may sometimes be secured to studs, the ends of which are inserted in apertures formed in the blades or elsewhere in the steel bit body.

Figure 3:
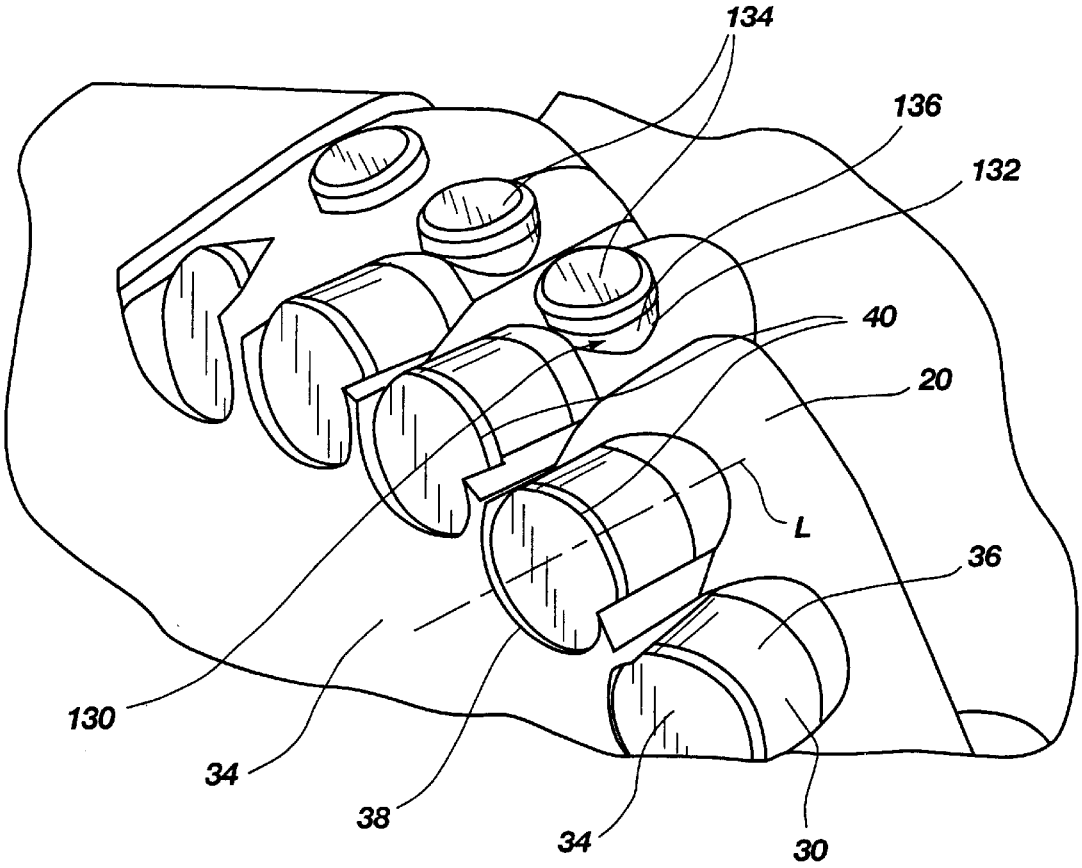
FIG. 3 is an enlarged perspective view looking upward and to the rear from a position below and rotationally leading a blade of the bit of FIG. 1 as normally oriented for drilling.
Figure 4:
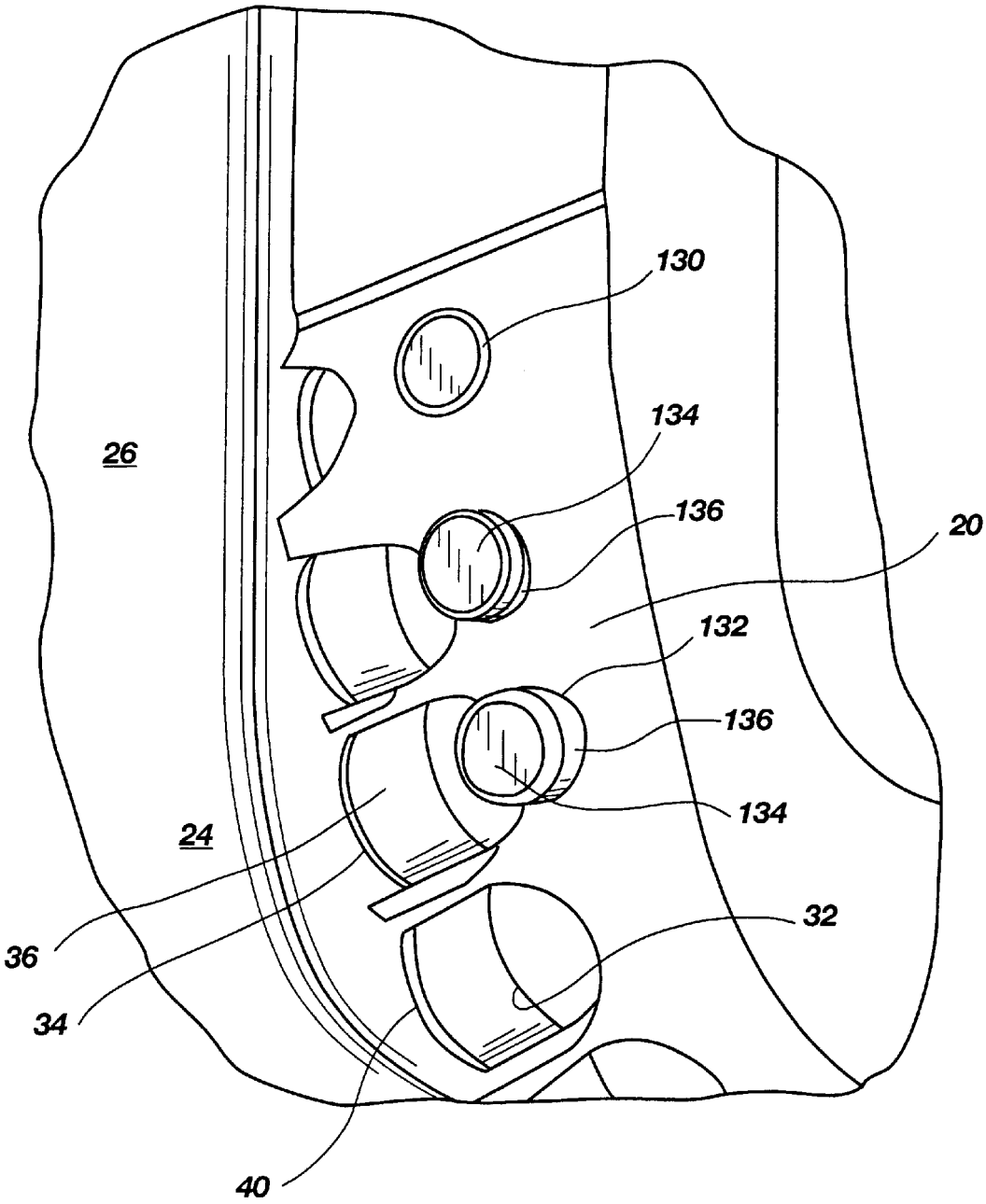
FIG. 4 is an enlarged perspective view looking slightly upward and rotationally forward from a position below and rotationally behind a blade of the bit of FIG. 1 as normally oriented for drilling.
Figure 5:
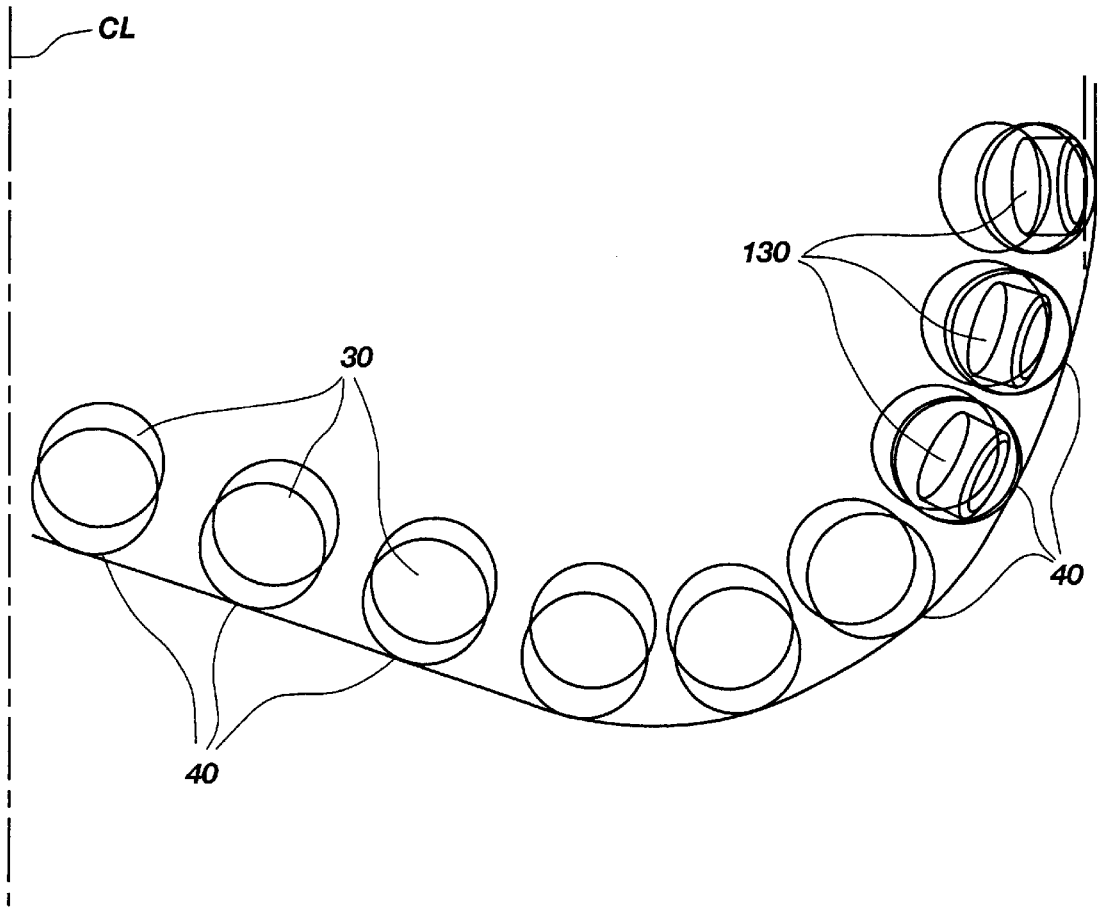
FIG. 5 comprises a line drawing showing cutting element positions on a blade of the bit of FIG. 1.
Figure 6:
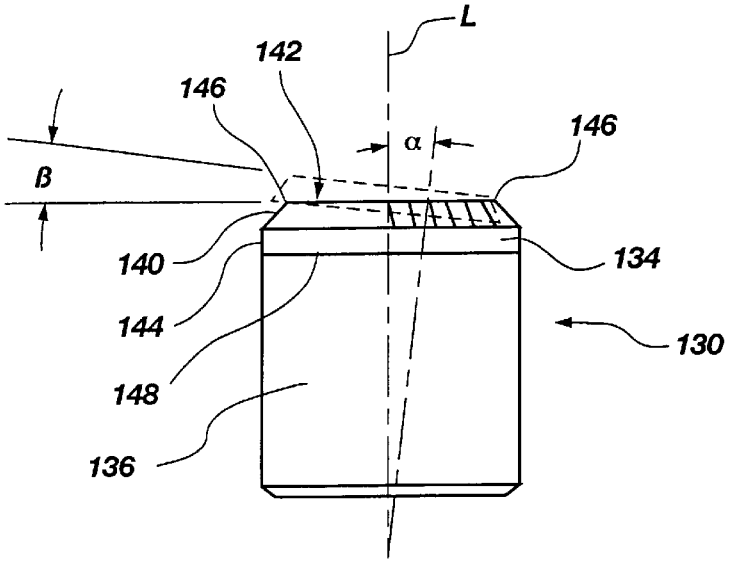
FIG. 6 is a side elevation of one suitable configuration of a second cutting element for use according to the invention.

Also secured to blades 20 and in the shoulder region of the bit face 14 is a plurality of second cutting elements 130, also each preferably comprised of a disc-like superabrasive table 134 formed on a substantially cylindrical, supporting cemented carbide substrate 136 (see FIG. 3). Second cutting elements 130 are each mounted in pockets 132 rotationally behind and (in this embodiment, on the same blade 20) at a location on the bit profile at least partially intermediate two associated, rotationally leading first cutting elements 30, each such combination of two first cutting elements 30 with a second cutting element 130 comprising a cutting assembly according to the invention. Unlike first cutting elements 30, however, second cutting elements 130 are oriented substantially transverse to the bit face (or, for simplicity, to the aforementioned reference plane), with the sides of superabrasive tables 134 facing in an intended direction of bit rotation.

It will be appreciated by those of ordinary skill in the art that, at some locations along the bit profile, which extends from the centerline CL of the bit along the outer face surface or profile of blades 20 to gage pads 22, the at least partially intermediate location of a second cutting element 130 will be somewhat more radially than longitudinally (in the direction of centerline CL) intermediate the locations of associated first cutting elements 30. On the other hand, when adjacent or near gage pads 22 as on the shoulder of the bit face 14, the at least partially intermediate location of a second cutting element 130 may approximate the radial locations of its associated first cutting elements 30 while being somewhat more longitudinally intermediate first cutting elements 30. Second cutting elements 130 may be structured, configured and oriented as previously described herein with respect to drill bit 10.

Figure 9:
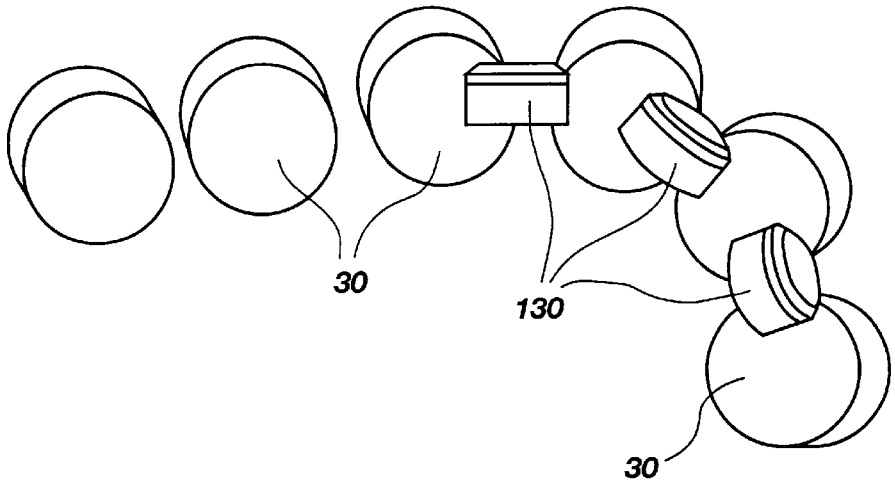
FIG. 9 comprises an enlarged perspective elevation of a second embodiment of cutting assemblies according to the invention as arranged on the bit of FIG. 8.

FIG. 9 of the drawings is an enlarged depiction of first cutting elements 30 and second cutting elements 130 arranged in accordance with the second embodiment of the invention as on blade 20*a* of bit 110 of FIG. 8, and oriented in the same direction (i.e., the bit being inverted) for clarity. The bit body 12, and specifically blade 20*a,* has been omitted for clarity. The view of FIG. 9 is taken from rotationally behind first cutting elements 30. From this view, one of ordinary skill in the art may observe and appreciate that the intermediate placement of second cutting elements 130 in this embodiment of the invention affords protection to the outer edges of the blades laterally between first cutting elements 30, which outer edges have been observed to wear unduly in certain drilling situations involving bit vibration and precession, including whirl. Such situations may occur frequently during directional drilling when the centerline of a bit is often canted or tilted, or offset, with respect to the axis of the borehole, and side loading of the bit is of substantial magnitude. Thus, in addition to the aforementioned advantages provided by the cutting assemblies of the first embodiment of the invention, the cutting assemblies of the second embodiment of the invention provide an additional advantage in terms of bit body protection with respect to prevention of first cutting element loss due to failure of the surrounding blade material.

Figure 10:
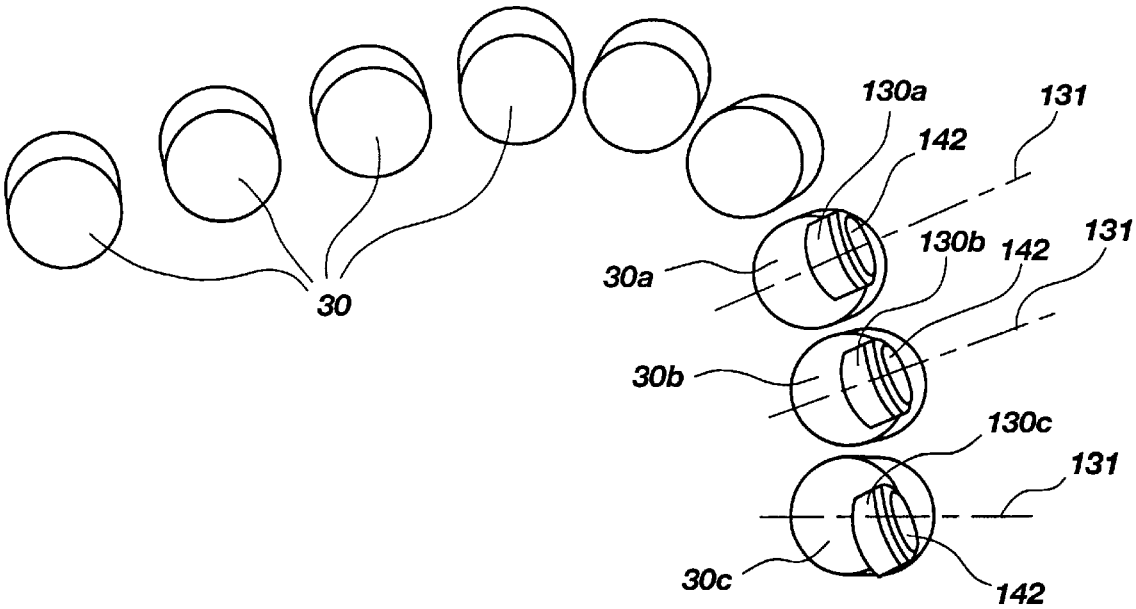
FIG. 10 comprises a perspective elevation of cutting elements arranged according to the invention as depicted in FIG. 1, wherein a second cutting element is disposed at a side rake.
Figure 11:
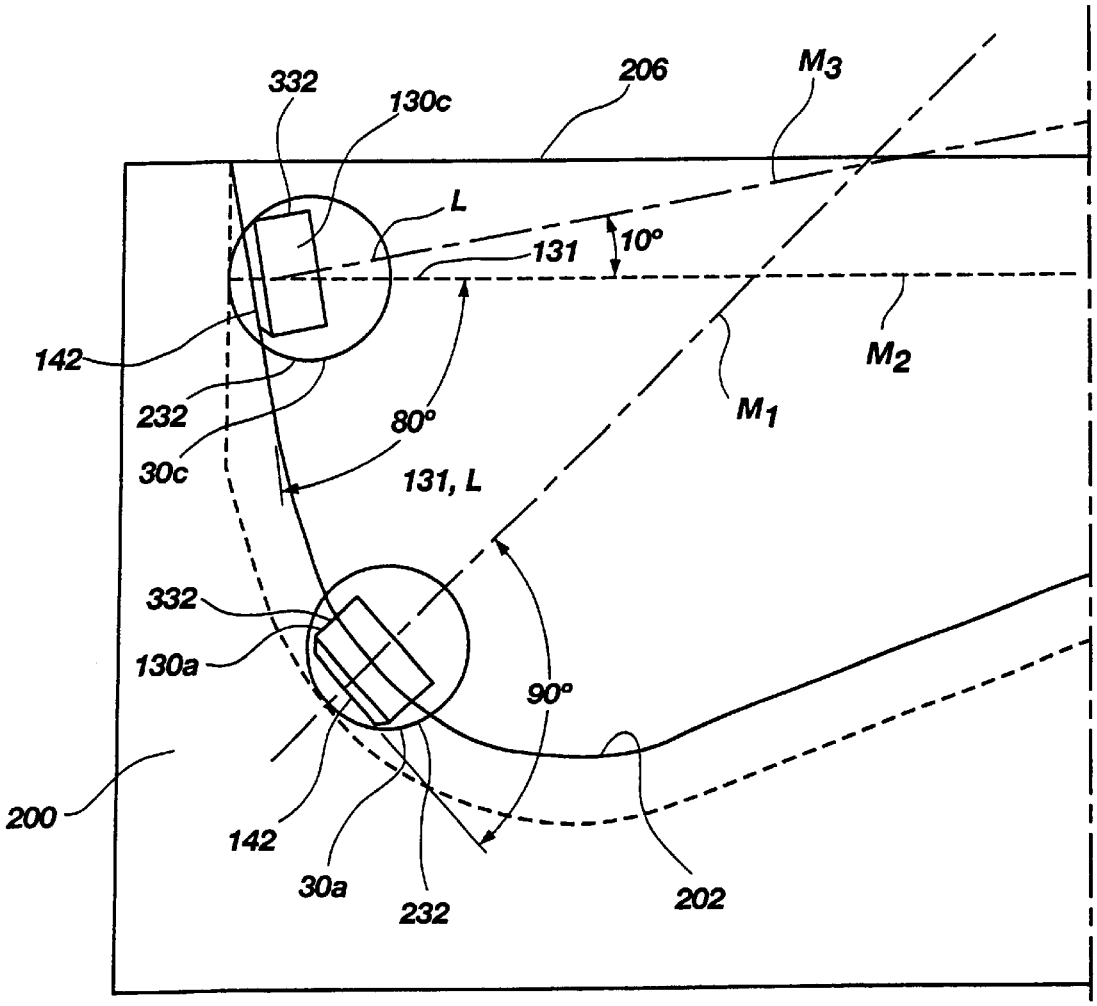
FIG. 11 comprises a schematic side elevation of one side of a bit mold for fabrication of a bit according to the invention, illustrating the manner in which the side rake of a second cutting element may be achieved.

FIGS. 10 and 11 of the drawings illustrate yet another feature of the present invention. As may be observed in FIG. 10, which is similar to FIG. 9 in that it omits bit body 12 and blade 20 of bit 10 (rather than bit 110 as in FIG. 9), second cutting elements 130*a,* 130*b* and 130*c* are shown to be rotationally trailing respective associated first cutting elements 30*a,* 30*b,* and 30*c* and in substantial alignment therewith in the direction of bit rotation. Clearance faces 142 of second cutting elements 130*a* and 130*b* are oriented, taken in a radial direction extending from the bit centerline CL, substantially perpendicular to centerlines 131 of the cutting faces 38 of associated first cutting elements 30*a* and 30*b,* centerlines 131 being taken perpendicular to the bit profile at the respective locations of first cutting elements 30*a* and 30*b*. On the other hand, second cutting element 130*c* is oriented with its clearance face 142 canted or tilted with respect to centerline 131 of associated first cutting element 30*c*. The reason for this orientation may be more easily appreciated with reference to FIG. 11, which is a schematic illustration of, for example, locations in a bit mold 200 of a first cutting assembly comprising first and second cutting elements 30*a* and 130*a* and a second cutting assembly comprising first and second cutting elements 30*c* and 130*c*. As is well known to those of ordinary skill in the art of matrix bit body fabrication, pockets 232 and 332 representing cutting element locations are milled into the inside surface 202 of the bit mold cavity 204, the pockets then being filled with displacements sized and shaped as the cutting elements to be later placed on the bit face 14 and specifically on blades 20 in a blade-type bit, to define pockets 32 and 132 on bit body 12 by preventing particulate tungsten carbide or other matrix material and molten binder, usually copper-based, from filling the intended locations of pockets 32 and 132 during an infiltration operation used to form the bit body 12.

As may be confirmed with reference to FIG. 11, the pocket 332 for the displacement defining the location of second cutting element 130*a* has a longitudinal axis L parallel to the centerline 131 of the location of first cutting element 30*a* to be located at pocket 232 and, thus, clearance face 142 of second cutting element 130*a* is at a 90° angle to centerline 131. The milling tool employed to machine pocket 332 may be oriented to easily clear the lip 206 of bit mold 200 and achieve the desired mill angle, along line $M_1$.

However, when it is desired to mill a pocket 332 for a displacement at the location of second cutting element 130*c* high on the shoulder of a blade 20, it is evident that one cannot mill at a desirable mill angle, taken along line $M_2$, as the milling tool would be interfered with by the opposing side (not shown) of bit mold 200. As an alternative and to provide an acceptable angle for clearance face 142 of second cutting element 130*c*, the mill angle is adjusted, for example, about 10°, to lie along line $M_3$ so as to clear mold 200. This provides an angle between clearance face 142 of second cutting element 130*c* and centerline 131 of its associated first cutting element 30*c* of about 80°. This minimal "side rake" of second cutting element 130*c*, as such tilt or cant is defined for purposes of clarity in description in the present application, still enables superabrasive table 134 of second cutting element 130*c* to serve as a radial bearing surface and to cut tangentially, as required. While illustrated with respect to placement of second cutting elements 130 in the cutting assembly configuration of bit 10, this aspect of the invention has equal utility with respect to placement and orientation of second cutting elements 130 in the cutting assembly configuration of bit 110.

The term "superabrasive" as used herein is not limited to polycrystalline diamond compact (PDC) structures employed on the preferred embodiment. Rather, the term includes, without limitation, thermally stable PDC's (also termed "thermally stable products," or "TSP's") and cubic boron nitride. Moreover, as used herein, the term "superabrasive table" means a mass or volume of mutually bonded superabrasive particles, as distinguished from superabrasive particles distributed within a carrier matrix of another material such as tungsten carbide.

While the present invention has been disclosed in the context of a rotary fixed cutter bit, it is not so limited. The present invention may be employed with any drilling tool, including by way of example and without limitation reaming-while-drilling tools, eccentric and bi-centered bits, any other reaming apparatus, and core bits.

While the present invention has been described and illustrated in the context of a currently preferred embodiment, those of ordinary skill in the art will recognize and appreciate that it is not so limited. Rather, additions, deletions and modifications to the embodiment as disclosed herein may be made without departing from the spirit and scope of the invention as defined by the claims hereof.

What is claimed is:

1. A cutting assembly for a drill bit for drilling subterranean formations, the cutting assembly comprising:

at least one first cutting element comprising a first superabrasive table having a cutting face, a side and a first cutting edge defined at the side along a peripheral portion of the cutting face, the first superabrasive table being positioned in an orientation suitable for engaging a formation with the first cutting edge; and a second cutting element positioned adjacent the at least one first cutting element, the second cutting element comprising a second superabrasive table having a clearance face exhibiting a first lateral extent along a portion thereof, a side edge exhibiting a second lateral extent greater than the first lateral extent and in proximity to the first lateral extent, a rake face located between the clearance face and the side edge along a peripheral portion of the clearance face, and a second cutting edge defined between the clearance face and the rake face, the second cutting element being positioned in an orientation suitable for engaging the formation with the second cutting edge.

2. The cutting assembly of claim 1, wherein the at least one first cutting element further comprises a first substrate having an end face carrying the first superabrasive table and the second cutting element comprises a second substrate having an end face carrying the second superabrasive table.

3. The cutting assembly of claim 2, wherein the first and second substrates are substantially cylindrical and the first and second superabrasive tables are generally disc-like in shape.

4. The cutting assembly of claim 1, wherein the rake face comprises at least a semifrustoconical surface.

5. The cutting assembly of claim 4, wherein the at least a semifrustoconical surface comprises at least one of a smooth, arcuate surface or a plurality of flat, laterally adjacent facets.

6. The cutting assembly of claim 1, wherein the rake face comprises a plurality of adjacent, arcuate surfaces.

7. The cutting assembly of claim 1, wherein the at least one first cutting element and the second cutting element are cooperatively mounted so that the first cutting edge of the at least one first cutting element is exposed to a greater degree than the second cutting edge of the second cutting element.

8. The cutting assembly of claim 1, wherein the first superabrasive table is mounted to a first substrate having a first longitudinal axis, the second superabrasive table is mounted to a second substrate having a second longitudinal axis, the at least one first cutting element is positioned with the first longitudinal axis of the first substrate oriented at an acute angle of less than about 45° to a reference plane, and the second cutting element is positioned with the second longitudinal axis of the second substrate positioned substantially transverse to the reference plane.

9. The cutting assembly of claim 8, wherein the first cutting edge lies farther away from the reference plane than the second cutting edge.

10. The cutting assembly of claim 8, wherein the second longitudinal axis is tilted at an angle of less than about 25° to a line perpendicular to the reference plane.

11. The cutting assembly of claim 10, wherein the second longitudinal axis is tilted away from the at least one first cutting element.

12. The cutting assembly of claim 11, wherein the first cutting edge lies farther away from the reference plane than the second cutting edge.

13. The cutting assembly of claim 1, wherein the second superabrasive table is at least about 0.030 inch thick, measured at a side thereof between the clearance face and a boundary of the side edge thereof opposite the clearance face.

14. The cutting assembly of claim 1, wherein the second superabrasive table includes a side wall extending from the rake face to a boundary with a supporting substrate.

15. The cutting assembly of claim 14, wherein the second cutting element is positioned so that engagement of the second cutting edge with the formation is limited to a depth so that the supporting substrate remains out of contact with the formation.

16. The cutting assembly of claim 1, wherein the at least one first cutting element comprises a single first cutting element and the second cutting element is located substantially in alignment with the single first cutting element, taken in a direction of intended movement of the cutting assembly in use.

17. The cutting assembly of claim 1, wherein the at least one first cutting element comprises two, substantially laterally adjacent first cutting elements, and the second cutting element is located at least partially laterally intermediate the two first cutting elements.

18. The cutting assembly of claim 1, wherein the cutting face of the at least one first cutting element has a centerline, and the clearance face of the second cutting element is oriented substantially perpendicular to the centerline of the cutting face of the at least one first cutting element.

19. The cutting assembly of claim 1, wherein the cutting face of the at least one first cutting element has a centerline, and the clearance face of the second cutting element is oriented at an acute angle to a line perpendicular to the centerline of the cutting face of the at least one first cutting element.

20. A rotary drill bit for drilling subterranean formations, comprising:

a bit body carrying at least one cutting assembly, comprising:

at least one first cutting element comprising a first superabrasive table having a cutting face, a side and a first cutting edge defined at the side along a peripheral portion of the cutting face, the first superabrasive table being positioned with the cutting face oriented generally facing in an intended direction of bit rotation and suitable for engaging a formation with the first cutting edge; and a second cutting element positioned adjacent and rotationally behind the at least one first cutting element, the second cutting element comprising a second superabrasive table having a clearance face exhibiting a first lateral extent along a portion thereof, a side edge exhibiting a second lateral extent greater than the first lateral extent and in proximity to the first lateral extent, a rake face located between the clearance face and the side edge along a peripheral portion of the clearance face, and a second cutting edge defined between the clearance face and the rake face, the second cutting element being positioned with at least a portion of the rake face generally facing in the intended direction of bit rotation in an orientation suitable for engaging the formation with the second cutting edge.

21. The rotary drill bit of claim 20, wherein the at least one first cutting element further comprises a first substrate having an end face carrying the first superabrasive table and the second cutting element comprises a second substrate having an end face carrying the second superabrasive table.

22. The rotary drill bit of claim 21, wherein the first and second substrates are substantially cylindrical and the first and second superabrasive tables are generally disc-like in shape.

23. The rotary drill bit of claim 20, wherein the rake face comprises at least a semifrustoconical surface.

24. The rotary drill bit of claim 23, wherein the at least a semifrustoconical surface comprises at least one of a smooth, arcuate surface or a plurality of flat, laterally adjacent facets.

25. The rotary drill bit of claim 20, wherein the rake face comprises a plurality of adjacent, arcuate surfaces.

26. The rotary drill bit of claim 20, wherein the at least one first and the second cutting elements are cooperatively mounted so that the first cutting edge of the at least one first cutting element is exposed to a greater degree than the second cutting edge of the second cutting element.

27. The rotary drill bit of claim 20, wherein the at least one first cutting element has a first longitudinal axis and the first superabrasive table is mounted to a first substrate, the second cutting element has a second longitudinal axis and the second superabrasive table is mounted to a second substrate, the at least one first cutting element is positioned with the first longitudinal axis oriented at an acute angle of less than 45° to a reference plane, and the second cutting element is positioned with the second longitudinal axis positioned substantially transverse to the reference plane.

28. The rotary drill bit of claim 27, wherein the first cutting edge lies farther away from the reference plane than the second cutting edge.

29. The rotary drill bit of claim 27, wherein the second longitudinal axis is tilted at an angle of less than about 25° to a line perpendicular to the reference plane.

30. The rotary drill bit of claim 29, wherein the second longitudinal axis is tilted away from the at least one first cutting element.

31. The rotary drill bit of claim 30, wherein the first cutting edge lies farther away from the reference plane than the second cutting edge.

32. The rotary drill bit of claim 20, wherein the second superabrasive table is at least about 0.030 inch thick, measured at a side thereof between the clearance face and a boundary of the side edge thereof opposite the clearance face.

33. The rotary drill bit of claim 20, wherein the second superabrasive table includes a side wall extending from the rake face to a boundary with a supporting substrate.

34. The rotary drill bit of claim 33, wherein the second cutting element is positioned so that engagement of the second cutting edge with the formation is limited to a depth so that the supporting substrate remains out of contact with the formation.

35. The rotary drill bit of claim 20, wherein the at least one cutting assembly is located on a blade projecting from the bit body.

36. The rotary drill bit of claim 35, further including a plurality of blades projecting from the bit body, the at least one cutting assembly comprises a plurality of cutting assemblies, and wherein at least some blades of the plurality carry at least one cutting assembly of the plurality of cutting assemblies.

37. The rotary drill bit of claim 20, wherein the at least one first cutting element comprises a single first cutting element and the second cutting element is located substantially in alignment with the single first cutting element, taken in the direction of intended bit rotation.

38. The rotary drill bit of claim 20, wherein the at least one first cutting element comprises two, substantially laterally adjacent, first cutting elements, and the second cutting element is located at least partially laterally intermediate the two first cutting elements.

39. The rotary drill bit of claim 20, wherein the cutting face of the at least one first cutting element has a centerline, and the clearance face of the second cutting element is oriented substantially perpendicular to the centerline of the cutting face of the at least one first cutting element.

40. The rotary drill bit of claim 20, wherein the cutting face of the at least one first cutting element has a centerline, and the clearance face of the second cutting element is oriented at an acute angle to a line perpendicular to the centerline of the cutting face of the at least one first cutting element.

* * * * *

UNITED STATES PATENT AND TRADEMARK OFFICE

CERTIFICATE OF CORRECTION

PATENT NO. : 6,408,958 B1 
DATED : June 25, 2002
INVENTOR(S) : Matthew R. Isbell et al.

It is certified that error appears in the above-identified patent and that said Letters Patent is hereby corrected as shown below:

Drawings,
Fig. 11, insert element number -- 204 -- to indicate the "mold cavity"
Please replace FIG. 11 with the following:

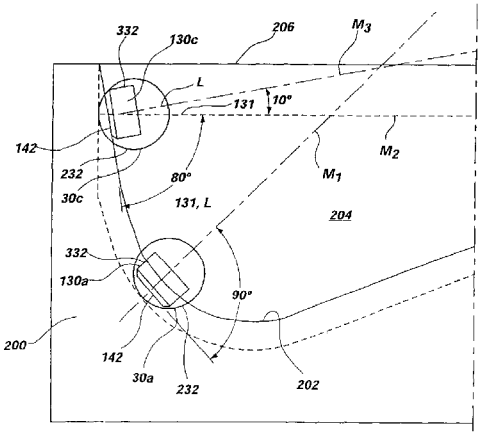

Fig. 11

Signed and Sealed this

Seventeenth Day of August, 2004

JON W. DUDAS
*Acting Director of the United States Patent and Trademark Office*